United States Patent [19]

Campbell

[11] Patent Number: 4,856,913

[45] Date of Patent: Aug. 15, 1989

[54] POOL SWEEP BAG

[76] Inventor: Sanford F. Campbell, 1850 Crestmont Dr., Redding, Calif. 96002

[21] Appl. No.: 155,307

[22] Filed: Feb. 12, 1988

[51] Int. Cl.[4] ..... B65D 33/16

[52] U.S. Cl. ..... 383/42; 383/44; 383/43; 383/102; 220/1 T

[58] Field of Search ..... 383/42, 43, 44, 53, 383/57, 58, 61, 117, 102, 905, 904; 220/1 T

[56] References Cited

U.S. PATENT DOCUMENTS

| | | | |
|---|---|---|---|
| 1,089,279 | 3/1914 | Simer et al. | 383/42 |
| 1,553,241 | 9/1925 | Hickey | 383/76 |
| 3,251,390 | 5/1966 | Evans | 383/43 |
| 4,344,274 | 8/1982 | Heismann | 383/42 |
| 4,498,190 | 2/1985 | Garlick, III | 383/102 |
| 4,503,559 | 3/1985 | Warnke | 383/117 |
| 4,630,312 | 12/1986 | Milstein | 383/102 |

*Primary Examiner*—Willis Little

*Attorney, Agent, or Firm*—Leonard D. Schappert

[57] ABSTRACT

A pool sweep bag is provided for use in holding debris collected by pool sweeps and pool cleaners constructed of porous material and having a collapsible snout section at the bottom end and a closable seam at the top end.

2 Claims, 3 Drawing Sheets

POOL SWEEP BAG

BACKGROUND OF THE INVENTION

1. Field of the Invention.

The present invention relates generally to pool sweeps and devices utilized with pool sweeps, and more specifically to a bag designed to collect refuse from the pool sweep during operation of the unit. More particularly, the bag includes means of attachment to an output of a pool sweep and at least a portion constructed of porous material having sufficiently sized holes to allow water to pass therethrough without allowing most debris to pass therethrough.

2. Description of the Prior Art.

In the past, inventors have directed their efforts toward the construction of pool sweep units which include bags constructed of somewhat porous material to collect leaves and other debris while allowing water to pass therethrough. Such bags for use with pool sweeps or pool cleaners have generally included at least one means of opening the bag aside from removing it from the pool sweep or pool cleaner to allow removal of debris held therein. Some of such bags have been constructed utilizing sufficiently flexible material to allow the bag to fold over when not in use, thereby minimizing the likelihood that refuse held in the bag will make its way back into the pool sweep to which the bag is attached. None of the prior art of which applicant is aware has taught a bag having the unique features of the present invention.

SUMMARY OF THE INVENTION

The present invention consists of a pool sweep bag for use with pool sweeps and pool cleaners, which are generally used to clean the bottom of swimming pools and to remove leaves and other debris therefrom. The main portion of the bag is constructed of a porous material having holes of sufficiently large size to allow water or other liquid to pass therethrough easily, but of sufficiently small size to restrict the passage of most debris collected from a pool. More particularly, the bag of the present invention includes a piece of porous material formed into the shape of a pool sweep bag having a top and a bottom and an opening positioned at the bottom to allow attachment of the pool sweep bag to the outlet of a pool sweep or pool cleaner, so that debris from the pool sweep or pool cleaner can enter the bag. The bag of the present invention further includes a joined section which is generally seamed, extending from the bottom end up to the top end. A second seam is positioned at the top of the pool sweep bag and oriented substantially perpendicularly to the vertical seam just mentioned. The second seam at the top of the pool sweep bag is constructed utilizing velcro hook material or equivalent on one piece of material and velcro loop material or equivalent on the other side of the seam to facilitate opening and closing of the top seam, thereby allowing removal of debris therefrom. While velcro was utilized herein, any attaching means capable of facilitating easy opening and closing of the second seam would be acceptable.

One of the objects of the present invention is to provide a pool sweep bag which is constructed of sufficiently porous material to allow water to pass therethrough, but having sufficiently small holes to prevent most debris from the pool from passing therethrough.

Another object of the present invention is to provide a pool sweep bag having an unique snout where it attaches to the outlet of a pool sweep or pool cleaner designed in such a way that, when no water is flowing through the output of the pool sweep or pool cleaner, the snout closes to prevent leaves and other debris captured inside the pool sweep bag from falling back into the pool sweep or pool cleaner.

Another object of the present invention is to provide a pool sweep bag having a top seam which is oriented substantially perpendicularly to the main vertical seam of the bag which is openable and closable to facilitate easy removal of debris captured in the bag.

A further object of the present invention is to provide a pool sweep bag having a collapsible snout which opens while water is flowing from the outside of the pool sweep into the snout of the pool sweep bag, which collapses to capture debris inside the pool sweep bag when no pressure is present, and which is designed to allow debris to collect around the outside of the snout inside the pool sweep bag.

The foregoing objects, as well as other objects and benefits of the present invention, are made more apparent by the descriptions and claims which follow.

DESCRIPTION OF THE PREFERRED EMBODIMENT

Figure 1:
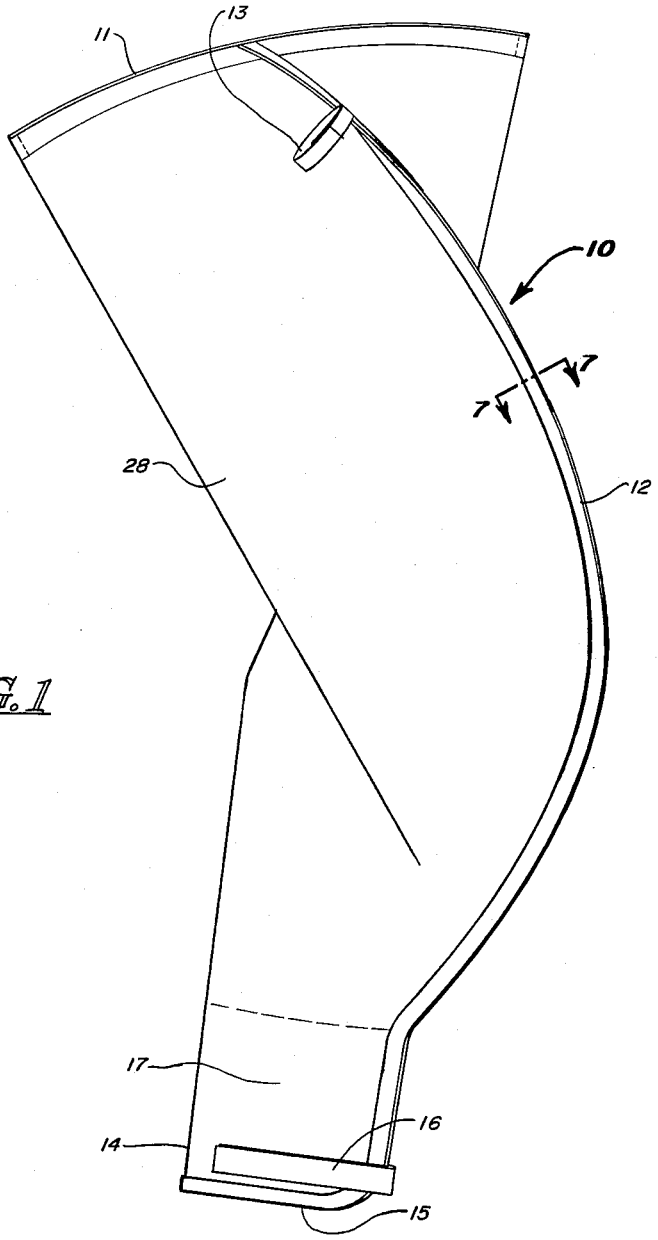
FIG. 1 of the drawings is a side view showing the construction of the pool sweep bag of the present invention.

FIG. 1 of the drawings is a side view showing the pool sweep bag 10 of the present invention in a semi-collapsed state. Pool sweep bag 10 is substantially constructed of porous material 28 which is chosen such that it is sufficiently porous to allow water or other liquid to pass therethrough relatively easily while restricting the flow of most debris collected by pool sweeps and pool cleaners. The main part of pool sweep bag 10 as shown in the present embodiment is constructed of a single piece of porous material 28 which is folded and seamed and sewn together to form vertical seam 12. While vertical seam 12 could be constructed to allow opening and closing thereof, in this particular embodiment it was permanently sewn. A second seam 11 is positioned at the top of pool sweep bag 10 and oriented substantially perpendicularly to seam 12. Seam 11 is constructed utilizing a velcro hook-type material or equivalent and a velcro loop-type material or equivalent to facilitate opening and closing thereof. The construction of seam 11 is shown in greater detail in FIGS. 3 and 6 of the drawings. Pool sweep bag 10 further includes a strap 13 positioned to allow an individual to remove pool sweep bag 10 from a pool sweep or pool cleaner by simply inserting the finger through strap 13 and lifting. At the bottom of pool sweep bag 10, a snout section 14 constructed of snout material 17 is provided. Further, an opening 15 is provided at the bottom of snout section 14 to allow attachment to a pool sweep or pool cleaner. A strap 16 wraps around snout section 14 and attaches by means of velcro hook-and-loop-type material or equivalent to create a snug fit of snout section 14 on the output of a pool sweep.

Figure 2:
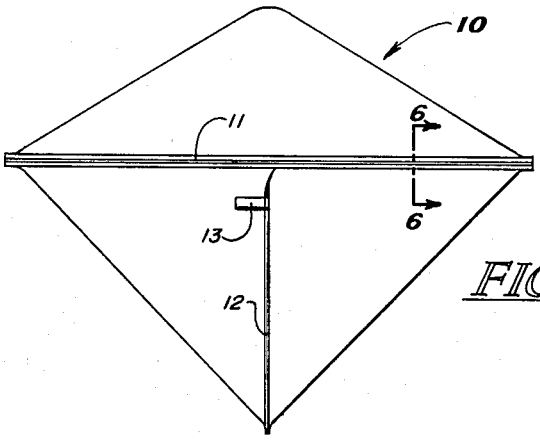
FIG. 2 is a top view of the pool sweep bag of FIG. 1 showing the positioning of the seam and the loop for lifting and carrying the bag.

FIG. 2 of the drawings is a top view of the pool sweep bag 10 of FIG. 1. Seam 11 is positioned and oriented substantially perpendicularly to seam 12, and loop 13 is attached to pool sweep bag 10 at seam 12.

Figure 3:
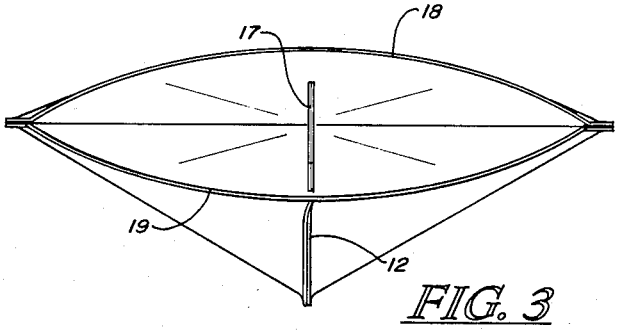
FIG. 3 is a top view of the pool sweep bag of FIG. 1 showing the top seam opened to facilitate removal of debris therefrom.

FIG. 3 is a top view of pool sweep bag 10 of FIG. 1 with seam 11 opened to show side 18 of seam 11, which is constructed utilizing hook-type velcro-type material, and side 19 of seam 11, which is constructed utilizing loop-type velcro-type material. Note also that snout material 17, of which snout section 14 is constructed, is here shown in a collapsed condition. When snout material 17 is in a collapsed condition as shown in FIG. 3, it is oriented substantially the same as is seam 12 of pool sweep bag 10.

Figure 4:
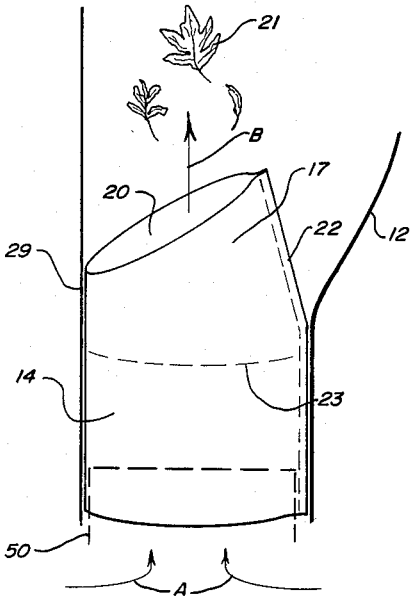
FIG. 4 is a side constructional view of the snout area of the pool sweep bag of FIG. 1 showing the position of the snout when water pressure is present at the input of the snout.

FIG. 4 is a side constructional view of the snout section 14 of pool sweep bag 10. Snout section 14 is constructed of snout material 17, which is generally constructed of a heavy vinyl material, creased at 29 and sewn together to form seam 22. Seam 22 of snout section 14 and seam 12 of pool sweep bag 10 may be sewn together as desired. Snout material 17 is also sewn to porous material 28 along seam 23 to hold it in position at the bottom end of pool sweep bag 10. An outlet 50 of a pool sweep or pool cleaner, as shown in dashed lines in FIG. 4, is inserted into the end of snout section 14, and water flows through outlet 50 along arrows A into snout section 14, forcing water along arrow B through opening 20 at the end of snout material 17.

Figure 5:
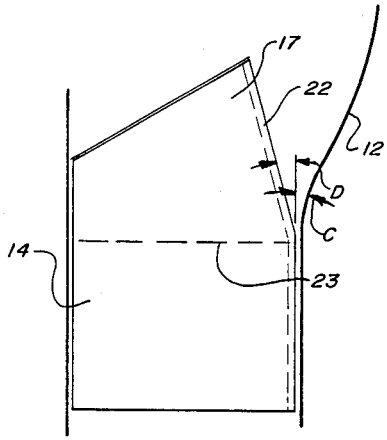
FIG. 5 is a side constructional view of the snout of the pool sweep bag of FIG. 1 showing the snout in a collapsed position, as it would be when no pressure is present at the snout.

FIG. 5 is a side constructional view of the snout section 14 of pool sweep bag 10. In this view, snout material 17 is collapsed to prevent the debris 21 of FIG. 4 from sliding back through opening 20 and into a pool sweep or pool cleaner to which pool sweep bag 10 has been attached. Because of the way in which the porous material 28 of pool sweep bag 10 is cut, the edge of seam 12 extends outward from snout section 14 at an angle D of approximately 25 degrees, and snout material 17 is further angled and seamed at an angle C of approximately 25 degrees inward from the edge of snout section 14. As a result, there is an angle of approximately 50 degrees between the edge of snout material 17 of snout section 14 and seam 12 of pool sweep bag 10. Consequently, much of the debris 21 collected in pool sweep bag 10 is deposited in the area between seam 22 of snout section 14 and seam 12 of pool sweep bag 10.

Figure 6:
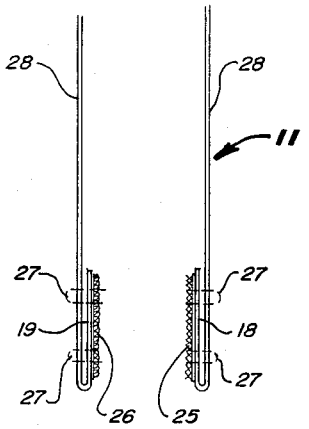
FIG. 6 is a cross-sectional view of the top seam of the pool sweep bag taken along lines 6—6 of FIG. 2 of the drawings.

FIG. 6 of the drawings is an expanded view of seam 11 of pool sweep bag 10 taken along lines 6—6 of FIG. 2 of the drawings. As here shown, porous material 28 is folded over, and a velcro-type loop-type material 26 is attached to seam section 19 and sewn together with thread 27 to provide one side of a velcro-type seam. At the other side, porous material 28 is folded over and sewn to a velcro-type hook-type material 25 by thread 27 to provide a seam section 18. Seam sections 18 and 19, when pressed together, attach to close the top of pool sweep bag 10.

Figure 7:
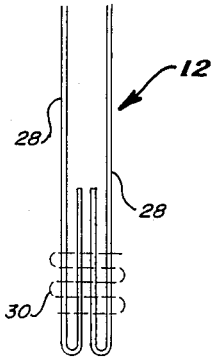
FIG. 7 is a cross-sectional view showing the construction of the seam taken along lines 7—7 of FIG. 1 of the drawings.

FIG. 7 is a cross-sectional view of seam 12 taken along lines 7—7 of FIG. 1. Porous material 28 is folded over and attached together by means of thread 30 as shown to provide a strong, durable seam 12.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A pool sweep bag for use with pool cleaners, pool sweeps and the like, comprising:

a body constructed of substantially flexible porous material having a top end and a bottom end, a left end and a right end, and a cavity therein;

a top seam extending substantially across said top end of said body constructed of hook-and-loop-type material to faciliate opening to provide access to said cavity in said body and closing of said top seam;

a side seam extending substantially from said top end to said bottom end of said body oriented substantially perpendicularly with respect to said top seam and positioned so that said side seam intersects said top seam substantially midway between said right end and said left end of said body;

a snout section positioned near said bottom end of said body having an opening therein which communicates with said cavity of said body, being constructed of material which collapses to hold debris in said pool sweep bag, and attaching means for securing said snout section of said pool sweep bag to an outlet of a pool cleaner.

2. The invention of claim 1, including a loop by which said pool sweep bag is lifted and transported.

* * * * *